United States Patent [19]

Acuncius et al.

[11] 4,118,223

[45] * Oct. 3, 1978

[54] THERMALLY STABLE HIGH-TEMPERATURE NICKEL-BASE ALLOYS

[75] Inventors: Dennis S. Acuncius; Robert Blanchard Herchenroeder, both of Kokomo; Russell W. Kirchner, Greentown; William L. Silence, Kokomo, all of Ind.

[73] Assignee: Cabot Corporation, Kokomo, Ind.

[ * ] Notice: The portion of the term of this patent subsequent to Aug. 23, 1994, has been disclaimed.

[21] Appl. No.: 772,321

[22] Filed: Feb. 25, 1977

Related U.S. Application Data

[63] Continuation of Ser. No. 179,922, Sep. 13, 1971, abandoned.

[51] Int. Cl.[2] ..... C22C 19/05

[52] U.S. Cl. ..... 75/171; 148/32.5; 148/162

[58] Field of Search ..... 75/171, 170; 148/32, 148/32.5, 162

[56] References Cited

U.S. PATENT DOCUMENTS

| | | | |
|---|---|---|---|
| 2,067,569 | 1/1937 | Hessenbruch | 75/171 |
| 3,203,792 | 8/1965 | Scheil et al. | 75/171 |
| 3,304,176 | 2/1967 | Wlodek | 75/171 |
| 4,043,810 | 8/1977 | Acuncius et al. | 75/171 |

*Primary Examiner*—R. Dean

*Attorney, Agent, or Firm*—Jack Schuman; Joseph J. Phillips

[57] ABSTRACT

A thermally stable, oxidation-resistant nickel-base alloy having good engineering properties for use in mechanical equipment operated at temperatures of up to 1600° F. or higher is provided by maintaining the nickel content above 50% by weight and including as essential elements from about 12 to about 18% chromium, from about 8 to about 18% molybdenum and from about 0.005 to about 0.2% lanthanum by weight. Additional elements may be included in limited amounts provided that the average $N_v$ number of the alloy as defined herein is not substantially above about 2.5 and preferably is below about 2.4.

9 Claims, 2 Drawing Figures

772321

THERMALLY STABLE HIGH-TEMPERATURE NICKEL-BASE ALLOYS

Figure 1:
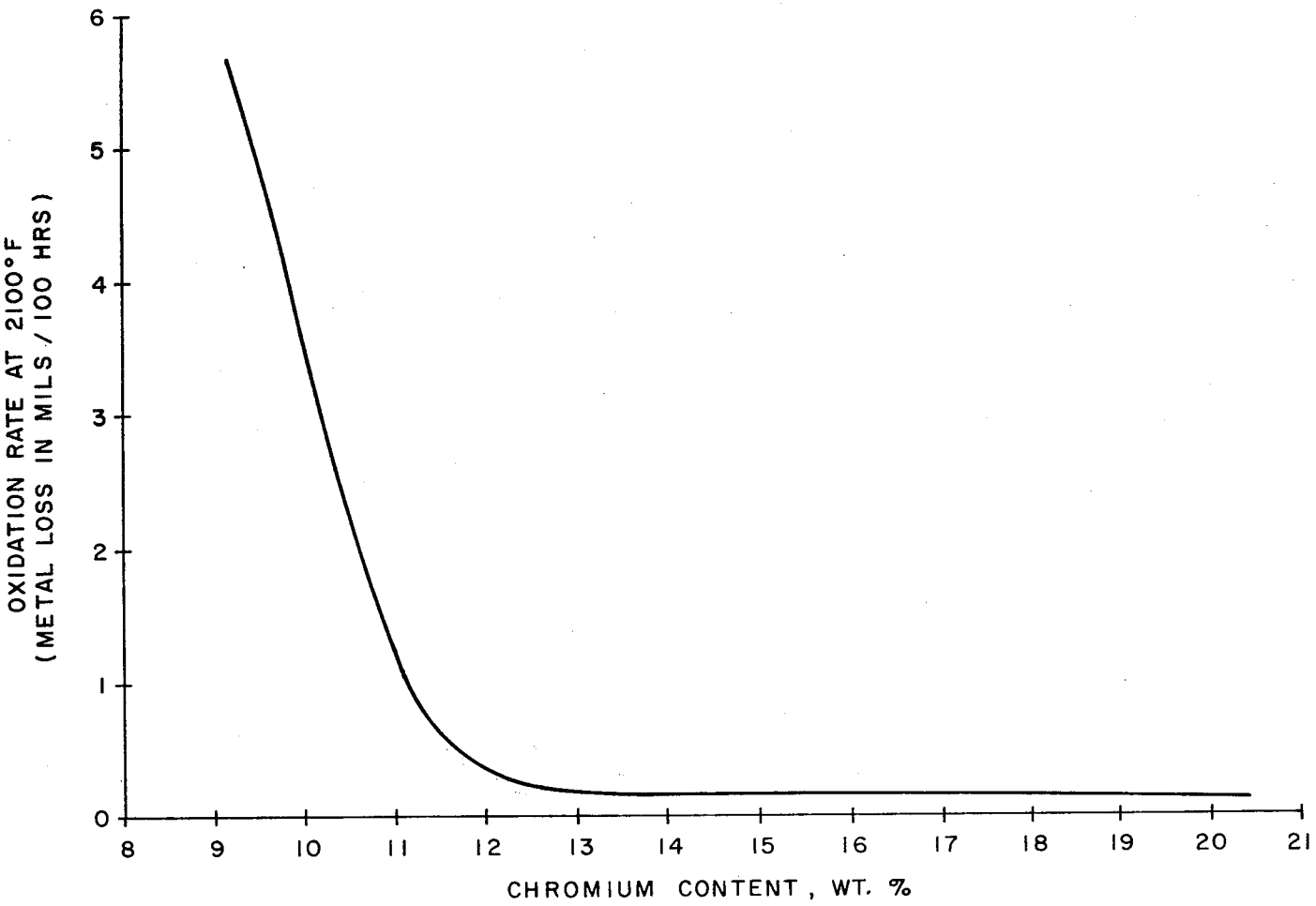

This application is a continuation of our copending application Ser. No. 179,922, filed Sept. 13, 1971, abandoned.

This invention relates to nickel-base alloys with an exceptional combination of good engineering properties and high temperature stability. More particularly it relates to essentially non-ferrous, solid solution-type nickel-base alloys of the Ni-Cr-Mo class which possess thermal stability, and high-temperature strength, oxidation resistance and low thermal expansion.

In the field of solid solution-strengthened nickel-base alloys, great emphasis has been placed in recent years on trying to provide improved structural materials for use in equipment exposed to various high-temperature conditions of the order of about 1500° F. and above. In fact, in many such applications, as in jet engine manufacture for example, there is a continuing tendency for operating temperature levels to increase still further as a result of higher and higher performance characteristics being sought by engineers and designers. For example, the sizable increase in power and efficiency which can be obtained from a typical gas turbine by an increase in operating temperature from 1500° to 1600° F. is pointed out by Sims and Beltran in U.S. Pat. No. 3,549,356.

Although many different approaches have been tried for improving nickel-base alloys with regard to service life at temperatures in the range of about 1600° F. or above, the ultimate goal of a combination of both superior oxidation (or corrosion) resistance and sustainable hot strength with adequate ductility under such stringent conditions has thus far defied a practical solution. For example, although the use of relatively large contents, e.g. 20% by weight or more, of chromium and elements like tungsten and molybdenum has yielded satisfactory high-temperature oxidation resistance and strength in several cases, the desired level of ductility has not been sustainable upon exposure at these service temperatures, because of changes in the internal structure of the alloys caused by thermal instabilities.

The principal object of the present invention is to provide nickel-base alloys with outstanding high-temperature integrity and stability and low thermal expansion. Another object is to provide such alloys which not only possess excellent high-temperature oxidation resistance and hot strength and low thermal expansion but which also have outstanding thermal stability and resistance to sudden loss of strength or integrity as a result of structural changes during heat aging or heat cycling.

It is a further object to provide solid solution-strengthened nickel-base alloys which can be readily produced and fabricated. Still another object is to provide such alloys which possess excellent resistance to change due to various thermal conditions and external influences. Another particular object is to provide nickel-base alloys suitable for use as high-temperature seal members and the like in various types of close tolerances, precision equipment due to their superior combination of mechanical properties and dimensional stability. Still other objects will be obvious or will become apparent from the following description of the invention and various preferred embodiments thereof.

In accordance with the present invention, the above objects and advantages are obtained by carefully controlling the composition of the nickel-base alloy within the ranges set forth in Table I.

TABLE I

| Ingredient | Range, Percent by Weight Broad | Preferred |
|---|---|---|
| Chromium | 12 - 18 | 14 - 17 |
| Molybdenum | 8 - 18 | 14 - 17 |
| Tungsten | 0 - 15* | <2 |
| Cobalt and Iron | 0 - 10 | <3 of each |
| Zirconium and Titanium | <0.5 | <0.5 |
| Aluminum | <0.5 | <0.5 |
| Carbon | <0.2 | <0.1 |
| Boron | <0.03 | <0.015 |
| Silicon | <1 | <0.5 |
| Manganese | <2 | <1 |
| Lanthanum | 0.005 - 0.2 | 0.005 - 0.1 |
| Nickel and Incidental Impurities | Balance (Ni > 50% | Balance (Ni > 55%) |

*Amount of W will depend on levels of other elements to give stably balanced compositions free of tendency to precipitate undesirable solid phases as explained hereinafter.

Figure 2:
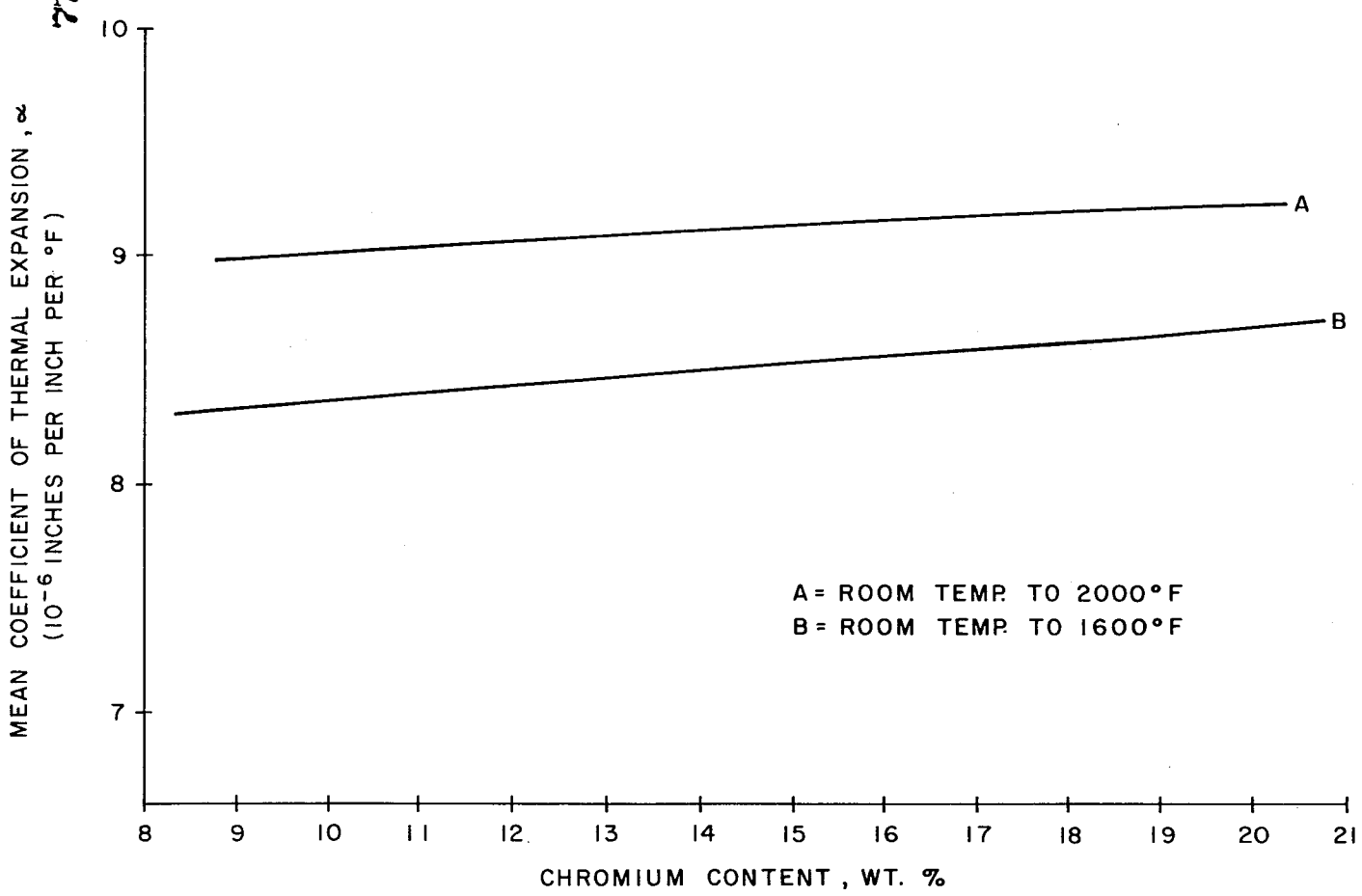

With reference to the drawings attached hereto, FIGS. 1 and 2 are graphic presentations showing the effects on important alloy characteristics of varying the chromium content while all other constituents were held squarely within the preferred ranges shown in Table I. In fact, in the experiments from which the graphic presentations of FIGS. 1 and 2 were drawn all constituents except Cr and Ni were kept essentially constant and in total amounted to about 20% by weight of the alloy (Mo alone being about 16%). Although cobalt and iron are not essential ingredients, small amounts of same are not harmful and will usually be included for economic reasons. The total cobalt-plus-iron content should never exceed 10% by weight of the alloy and in order to insure excellent stability in our system, we prefer to limit their presence to a maximum of about 3% of each. Neither are zirconium and titanium essential ingredients but they are mentioned in Table I because traces often remain from their use as deoxidation step additives.

Various other elements not mentioned in Table I, such as tantalum, niobium and hafnium are also tolerable in small amounts, e.g. totaling up to about 2% by weight of the alloy. However, their presence should be restricted to that of the usual adventitious or incidental minor inclusions since it is most important that the nickel content of our alloy be maintained at a level of at least about 50% by weight or above.

We have found that the use of the combination of essential elements in the proportions indicated in Table I assures the attainment of the exceptional combination of properties desired, namely outstanding high-temperature oxidation resistance, high-temperature strength and low thermal expansion without significant thermal instability or serious loss of ductility due to high-temperature exposure. Furthermore, the preferred concentration of nickel for best overall properties has been found to be between about 55 and about 70% by weight.

Chromium in the range of 12 to 18% is required in our alloys to provide hot corrosion and oxidation resistance. It also provides a good balance between strength and ductility in said range. Amounts of Cr below 12% do not provide adequate oxidation resistance above 2000° F., as can be seen from the graph of FIG. 1. Further, low Cr contents result in low ductilities of the annealed alloy in the intermediate temperature range of 1000°- 1400° F.

Furthermore, as shown in FIG. 2, the coefficient of thermal expansion is significantly increased as chromium replaces nickel in the alloys of present interest, so that chromium contents above 18% would unduly aggravate thermal expansion problems in various mechanical equipment, especially when operated over wide ranges of temperature.

Molybdenum must be present in our alloys in the range of at least about 8% by weight in order to provide solid solution-strengthening and low thermal expansion. But it must not exceed about 18% or else undesirable extraneous solid phases will form during high-temperature service with resultant loss of ductility as will be more fully explained hereinafter in conjunction with a discussion of the general phase relationships of our alloy system.

Tungsten can be included in amounts from about 5% to about 15% in order to decrease thermal expansion. However, it also tends to increase density and cost. Therefore, molybdenum and tungsten are not freely interchangeable in the present invention. Moreover, when tungsten is added in larger amounts within the above range, molybdenum must be closely restricted within the lower portion of its prescribed range to prevent the formation of undesirable topologically close-packed phases within the alloy. For these reasons we usually prefer to use about 14 - 17% of molybdenum and restrict tungsten to less than about 2% to avoid such undesirable phases.

The remaining essential element in our alloys is lanthanum. It must be present in a small but effective amount to impart superior high-temperature oxidation resistance. Normally, the recommended concentration is between about 0.005 and about 0.2% but we prefer the range from about 0.005 to about 0.1%. Exceeding about 0.25% is definitely not recommended because it merely increases costs without achieving significant further beneficial effects and may even introduce bad side effects such as processing difficulties.

Although no other elements are absolutely essential to the alloys of this invention, minor amounts of carbon, boron, silicon, manganese and aluminum can be deliberately included with desirable benefits. Attention is now drawn to Table II herein which presents detailed compositions of exemplary alloys of this invention including both the primary essential constituents as well as the minor or secondary elements.

TABLE II

| | Specific Alloy Compositions of the Present Invention | | | | | | | | | | | |
|---|---|---|---|---|---|---|---|---|---|---|---|---|
| | Chemical Composition, in Weight Percent | | | | | | | | | | | |
| Alloy Number | Co | Fe | Cr | Mo | W | Al | C | B | Si | Mn | La | Ni+ |
| 1 | 0.03 | 1.94 | 15.14 | 14.85 | 0.01 | 0.27 | 0.014 | 0.009 | 0.04 | 0.19 | 0.13 | Balance |
| 2 | 0.03 | 1.93 | 15.31 | 14.79 | 0.04 | 0.27 | 0.026 | 0.002 | 0.03 | 0.18 | 0.15 | " |
| 3 | 0.03 | 1.90 | 15.38 | 15.05 | <.10 | 0.24 | 0.005 | 0.001 | 0.2 | 0.20 | 0.12 | " |
| 5 | 0.03 | 2.07 | 15.03 | 14.08 | 1.74 | 0.28 | 0.008 | 0.014 | 0.03 | 0.2 | 0.11 | " |
| 6 | 0.03 | 1.93 | 15.09 | 12.22 | 5.55 | 0.25 | 0.003 | 0.017 | 0.03 | 0.19 | 0.10 | " |
| 7 | 0.03 | 2.08 | 14.72 | 10.30 | 10.20 | 0.28 | 0.01 | 0.019 | 0.03 | 0.18 | 0.09 | " |
| 9 | 0.03 | 1.99 | 12.10 | 10.18 | 15.62 | 0.26 | 0.006 | 0.025 | 0.03 | 0.19 | 0.08 | " |
| 15 | — | 1.97 | 15.01 | 14.21 | — | 0.29 | 0.02 | <0.001 | 0.02 | 0.17 | 0.13 | Balance |
| 17 | — | 1.99 | 15.11 | 14.66 | — | 0.25 | 0.04 | 0.005 | 0.02 | 0.17 | 0.13 | " |
| 18 | — | 2.05 | 15.21 | 14.66 | — | 0.29 | 0.02 | 0.014 | 0.02 | 0.17 | 0.13 | " |
| 103 | 0.22 | 0.90 | 14.51 | 14.66 | — | 0.20 | 0.007 | 0.010 | <0.01 | 0.04 | 0.018 | " |
| 145 | — | 0.10 | 14.88 | 15.82 | — | 0.18 | 0.07 | 0.002 | 0.53 | 0.27 | 0.14 | " |
| 146 | 0.04 | 0.22 | 14.96 | 17.22 | — | 0.19 | 0.07 | 0.002 | 0.49 | 0.28 | 0.11 | " |
| 147 | 0.04 | 0.09 | 14.55 | 14.21 | 5.70 | 0.17 | 0.06 | 0.002 | 0.52 | 0.28 | 0.11 | " |
| 150 | 0.04 | 0.09 | 12.04 | 15.62 | <.10 | 0.19 | 0.07 | 0.002 | 0.51 | 0.28 | 0.13 | " |
| 158 | — | — | 15.0 | 15.0 | — | 0.23 | 0.011 | 0.032 | — | — | 0.12 | " |
| 185 | — | — | 15.59 | 15.62 | — | — | 0.004 | — | <.01 | 0.24 | 0.09 | Balance |
| 186 | <.01 | 0.10 | 14.94 | 15.56 | <.10 | 0.18 | 0.02 | <.001 | 0.12 | 0.24 | 0.12 | " |
| 187 | 0.05 | 0.11 | 15.24 | 15.30 | <.10 | 0.28 | 0.06 | 0.002 | 0.39 | 0.29 | 0.12 | " |
| 197 | 0.02 | 0.16 | 16.65 | 15.30 | — | 0.21 | 0.03 | <.001 | 0.33 | 0.20 | 0.02 | " |
| 198 | 0.04 | 0.12 | 16.50 | 15.65 | — | 0.22 | 0.05 | <.001 | 0.33 | 0.16 | 0.06 | " |
| 200 | 0.02 | 1.96 | 16.55 | 15.45 | — | 0.23 | 0.02 | <.001 | 0.39 | 0.20 | 0.10 | " |
| 201 | 0.02 | 5.28 | 16.65 | 15.50 | — | 0.22 | 0.02 | <.001 | 0.37 | 0.19 | 0.09 | " |
| 218 | 0.02 | 0.14 | 13.93 | 17.47 | — | 0.19 | 0.08 | 0.001 | 0.45 | 0.28 | 0.01 | Balance |

+—Nickel and minor incidental impurities

Among the minor secondary elements, carbon can be added to promote carbide formation for added strength as is generally known. However, with the added strength one must accept some decrease in ductility of the annealed and aged alloy. For such reasons, when carbon is deliberately included in the present alloys, the amount should be limited to below about 0.2% and preferably below about 0.1%. To illustrate, Alloy 3 of Table II, which has a 0.005% C content, has a room temperature tensile ductility of about 66%, whereas Alloy 145, which has a carbon content of 0.07%, has a room-temperature ductility of about 51%. Furthermore, aging at 1600° F. for 1000 hours does not affect the tensile ductility of Alloy 3 but does decrease the ductility of Alloy 145 from 51% to 43%.

Likewise, minor amounts of boron can be added within the ranges specified in Table I to promote hot ductility. To illustrate, Gleeble high-temperature tensile tests on cast Alloy 15 of Table II, which contains less than 0.001% B, shows a reduction of area at 2100° F. of 11%, whereas cast Alloy 18 of Table II, which contains 0.014% B, shows a reduction of area at 2100° F. of 48%. This same trend holds true for temperatures at least down to 1800° F.

As is known in alloys of this general class, the oxidation resistance can often be improved by small additions of silicon. However, the amount of silicon must be carefully limited within the range specified by Table I in order to maintain stability.

The addition of manganese within the prescribed range improves the oxidation resistance of the alloys. To illustrate, Alloy 1 of Table II, which contains 0.19% manganese, has an oxidation rate measured as average depth in mils of metal oxidized per surface per 100 hours at 2000° F. of 0.08, while Alloy 158 of Table II, which contains less than 0.01% manganese, has an oxidation rate in the same units of 0.15. Similar differences are seen at 2100° F., i.e. 0.11 versus 0.23 respectively. More than 2% manganese provides little if any further gain in oxidation resistance and is, therefore, avoided to insure good stability of the alloys.

Aluminum or other deoxidants are usually added during processing to deoxidize the melt. Small residual amounts of such elements may remain in the finished alloy without harmful effect. However, the final concentration should be limited within the range specified in Table I in order to insure stability of the alloys.

To insure thermal stability of the present alloys, the overall composition of each specific alloy should be balanced to provide a relatively low, atomically averaged electron vacancy concentration number, i.e. $\overline{N}_v$. For the purposes of the present invention, We have found that the formation of troublesome intermetallic precipitates can be avoided by choosing a balanced composition for which said $\overline{N}_v$ has a value of not over about 2.5, and preferably less than about 2.4, when estimated by a simplified calculation procedure using the following mathematical formula:

$$\overline{N}_v = 0.66\,(AF_{Ni}) + 1.71(AF_{Co}) + 2.66\,(AF_{Fe}) + 3.66\,(AF_{Mn}) + 4.66\,(AF_{Cr}) + 5.66\,(AF_{Ta+Nb+V}) + 6.66\,(AF_{Zr+Ti+Si+Hf}) 7.66\,(AF_{Al+La}) + 8.66\,(AF_{Mg}) + 9.66\,(AF_{Mo+W})$$

where each "AF" indicates the actual atomic fraction in the alloy of the element or group of elements indicated by the respective subscripts thereon.

When this calculation is carried out for each of the specific exemplary alloys of Table II, the following results are obtained.

TABLE III

| Alloy Number | $\overline{N}_v$ |
|---|---|
| 1 | 2.28 |
| 2 | 2.29 |
| 3 | 2.32 |
| 5 | 2.30 |
| 6 | 2.34 |
| 7 | 2.40 |
| 9 | 2.51 |
| 15 | 2.23 |
| 17 | 2.26 |
| 18 | 2.27 |
| 103 | 2.20 |
| 145 | 2.34 |
| 146 | 2.43 |
| 147 | 2.46 |
| 150 | 2.20 |
| 158 | 2.21 |
| 185 | 2.29 |
| 186 | 2.28 |
| 187 | 2.32 |
| 197 | 2.37 |
| 198 | 2.38 |
| 200 | 2.42 |
| 201 | 2.49 |
| 218 | 2.38 |

The alloys of this invention can be produced by any of the techniques conventionally used in the manufacture of super alloys, such as arc or induction melting in air or vacuum, consumable electrode melting, electroslag remelting and vacuum arc remelting. Also, they may be shaped by forging, machining, casting or powder metallurgy techniques.

Most of the exemplary alloy batches listed in Tables II and III were made by induction melting. However, in a few cases, the initial step was carried out by arc melting in air or vacuum followed by remelting by either consumable electrode or electroslag technique. In all cases the addition of lanthanum was deferred until the latter stages of the melting cycle in order to avoid undue losses thereof.

In order to provide comparison materials for testing, the three batches of nickel-base alloys listed in Table IV were also prepared, as representative of various prior art teachings.

Samples of each of the comparison alloys of Table IV as well as several of the alloy compositions listed in Table II were forged to plate and subsequently hot rolled to about 60 mil sheet. Test specimens from the respective sheets were made and subjected to standardized tests for oxidation resistance, tensile strengths and stress rupture at various temperatures.

TABLE IV

SPECIFIC ALLOYS OUTSIDE PRESENT INVENTION

| Alloy Number | Chemical Composition, Weight Percent | | | | | | | | | | | | $\overline{N}_v$ |
|---|---|---|---|---|---|---|---|---|---|---|---|---|---|
| | Co | Fe | Cr | Mo | W | Al | C | B | Si | Mn | La | Ni+ | |
| 149 | 0.04 | 0.08 | 9.33 | 15.62 | <0.1 | 0.18 | 0.07 | 0.002 | 0.50 | 0.28 | 0.12 | Balance | 2.07 |
| 260 | — | 18.2 | 22.1 | 9.9 | 1.2 | — | 0.15 | — | 0.80 | — | 0.067 | Balance | 2.70 |
| 309 | 0.70 | 5.55 | 16.0 | 15.85 | 3.4 | 0.21 | 0.006 | — | 0.03 | 0.49 | — | Balance | 2.61 |

The procedure for the oxidation-resistance testing was as follows:

(1) Prepare specimens about ¾ inches × ¾ inches in size;

(2) Grind all surfaces to a 120 grit finish and degrease in acetone;

(3) Measure exact surface area and weight of each specimen;

(4) Expose specimens to dry air flow of about 3 cubic feet per hour per square inch of cross-sectional area through the furnace while maintaining a constant temperature therein for four 25-hour periods with the specimens being air-cooled to room temperature after each 25-hour period;

(5) Reweigh each specimen;

(6) Descale specimens in salt bath;

(7) Weigh the descaled specimens and calculate the weight loss in each;

(8) Convert these weight-loss figures to "average depth of metal lost" values in accordance with the following formula:

$$\frac{\text{Measured Weight Loss}}{\text{Density of Alloy}} \times \frac{1}{\text{Surface Area of Specimen}}$$

The results of these oxidation-resistance tests are presented in Table V.

TABLE V

| Alloy | Oxidation Test Results: Average Depth of Metal Lost, in mils | |
|---|---|---|
| | at 2000° F. | at 2100° F. |
| 1 | 0.08 | 0.11 |
| 3 | 0.07 | 0.14 |
| 145 | 0.07 | 0.12 |
| 146 | 0.08 | 0.13 |
| 147 | 0.09 | 0.28 |
| 150 | 0.08 | 0.26 |
| 158 | 0.15 | 0.23 |
| 198 | 0.08 | not available |
| 218 | 0.14 | not available |
| 149 | 0.12 | 5.35 |
| 260 | 0.40 | 0.71 |
| 309 | 0.83 | 3.58 |

It will be seen from Table V as well as from FIG. 1 that an alloy like 149, which contains only 9.33% chromium, has inadequate oxidation resistance at 2100° F. even with the lanthanum present. Nevertheless, it is obvious that small additions of lanthanum are effective in improving high-temperature oxidation resistance when the chromium and molybdenum contents are in the range specified in the present invention. (Compare the oxidation rate at 2100° F. of Alloy 309 with those for the alloys of this invention.)

The tensile testing was performed at various temperatures in the standard manner using either annealed specimens that had merely been solution heat-treated for 30 minutes at 2050° F. followed by rapid air cooling or other specimens which had also subsequently been aged at 1600° F. for 1000 hours and then air cooled. The results of such tests are presented in Table VI.

TABLE VI

| | | Tensile Properties | | | |
|---|---|---|---|---|---|
| Alloy | Condition | Test Temperatures | Ultimate Tens.Str. (K.s.i.) | 0.2% Yield Strength (K.s.i.) | Percent Elongation |
| 1 | annealed | rm.temp. | 115.5 | 49.4 | 70.6% |
| | annealed | 1600° F. | 48.8 | 27.2 | 39.4% |
| | aged | rm.temp. | 115.6 | 49.7 | 65.2% |
| 3 | annealed | rm.temp. | 115.3 | 50.0 | 65.4% |
| | annealed | 1600° F. | 52.2 | 29.4 | 41.1% |
| | aged | rm.temp. | 114.3 | 49.2 | 66.3% |
| 7 | annealed | rm.temp. | 120.0 | 48.7 | 61.8% |
| | annealed | 1600° F. | 55.6 | 31.4 | 46.1% |
| | aged | rm.temp. | 122.1 | 50.0 | 57.3% |
| 145 | annealed | rm.temp. | 129.4 | 57.8 | 50.8% |
| | aged | rm.temp. | 130.9 | 54.7 | 43.6% |
| 147 | annealed | rm.temp. | 137.6 | 64.0 | 48.2% |
| | annealed | 1700° F. | 43.6 | 26.0 | 21.4% |
| | aged | rm.temp. | 136.4 | 62.0 | 33.2% |
| 158 | annealed | rm.temp. | 113.9 | 46.5 | 68.3% |
| | annealed | 1700° F. | 40.7 | 23.5 | 90.2% |
| | aged | rm.temp. | 113.1 | 44.7 | 66.8% |
| 198 | annealed | rm.temp. | 125.0 | 51.6 | 56.6% |
| | annealed | 1600° F. | 49.9 | 27.6 | 33.3% |
| | aged | rm.temp. | 126.0 | 50.4 | 48.8% |
| 309 | annealed | rm.temp. | 115.0 | 49.0 | 70.9% |
| | annealed | 1700° F. | 42.8 | 26.8 | 50.1% |
| | aged | rm.temp. | 142.1 | 61.2 | 21.6% |

The data in Table VI show that typical alloys of this invention have at least adequate engineering strength at temperatures as high at 1600°– 1700° F. and comparable to prior-art alloys such as 309. Furthermore, this was confirmed by stress-rupture tests conducted at 1700° F. with an applied load of 8000 psi.

More importantly, the data of Table VI also show that upon aging at 1600° F. for 1000 hours the ductility of Alloy 309 at room temperature has dropped drastically, i.e. from about 71% elongation down to about 22%, whereas alloys of this invention often retain substantially all of their original ductility after being subjected to the same aging treatment. In fact, the greatest change in ductility caused by such aging of any of the alloys of this invention was the drop from about 48% elongation to about 33% which occurred in Alloy 147 and, as seen from Table III, it has an $\overline{N}_v$ value of 2.46, which is substantially above the preferred upper limit of 2.40.

Having thus described our invention, together with preferred embodiments thereof, what we claim is:

1. A thermally stable, high-temperature oxidation-resistant, nickel-base alloy containing more than 50% by weight of nickel and consisting essentially by weight from about 12 to about 18% chromium from about 8 to about 18% molybdenum and a small but effective amount to impart high temperature oxidation resistance of lanthanum not exceeding about 0.25% of the alloy, said alloy also containing by weight any of the following non-essential elements within the ranges indicated provided that the average $N_v$ number as defined herein does not substantially exceed about 2.5:

tungsten: 0 – 15%
cobalt and iron: 0 – 10%
zirconium and titanium: <0.5%
carbon: <0.2%
aluminium: <0.5%
boron: <0.03%
silicon: <1% and
manganese: <2% with the balance of the alloy being nickel and incidental impurities, and characterized by controlled thermal stability, a low coefficient or expansion and oxidation resistance at temperatures of about 1600° F. and above.

2. An alloy as defined in claim 1 wherein the amount of lanthanum is between about 0.005 and about 0.1% by weight.

3. An alloy as defined in claim 1 wherein the amount of tungsten is above about 5% but the content of molybdenum is restricted sufficiently within the above ranges to control the average $N_v$ number as specified.

4. An alloy as defined in claim 1 wherein the average $N_v$ number as defined herein does not exceed about 2.4.

5. A thermally stable and oxidation-resistant nickel-base alloy especially suitable for uses wherein temperatures in the range of 1400°–1600° F. and higher are commonly encountered containing at least 55% nickel by weight and consisting essentially by weight from about 14 to about 17% chromium from about 14 to about 17% molybdenum and from about 0.005 to about 0.2% lanthanum said alloy also containing by weight any of the following non-essential elements within the ranges indicated provided that the average $N_v$ number as defined herein does not exceed about 2.5:

tungsten: <2%
cobalt: <3%
iron: <3%
zirconium and titanium: <0.5%
aluminum: <0.5%
carbon: <0.1%
boron: <0.015% silicon: <0.5% and
manganese: <1%
with the balance of the alloy being nickel and incidental impurities, said alloy being characterized by controlled thermal stability, low coefficient of expansion and oxidation resistance at temperatures of about 1600° F. and above.

6. An alloy as defined in claim 5 wherein the amount of lanthanum is not over about 0.1% by weight.

7. An alloy as defined in claim 5 wherein the average $N_v$ number as defined herein does not exceed about 2.4.

8. A thermally stable, oxidation-resistant nickel-base alloy especially suitable for use in mechanical equipment operated over a considerable range of temperatures consisting essentially of the following elements by weight:

about 15% chromium
about 15% molybdenum and
about 0.02% lanthanum with the balance being nickel and minor amounts of compatible adventitious elements plus incidental impurities, said alloy being characterized by controlled thermal stability, low coefficient of expansion and oxidation resistance at temperatures of about 1600° F. and above.

9. An alloy as described in claim 8 wherein the average $N_v$ number as defined herein is between about 2.2 and about 2.4.

* * * * *

UNITED STATES PATENT AND TRADEMARK OFFICE

CERTIFICATE OF CORRECTION

PATENT NO. : 4,118,223
DATED : October 3,1978
INVENTOR(S) : Dennis S. Acuncius, Robert Blanchard Herchenroeder, Russell W. Kirchner and William L. Silence It is certified that error appears in the above-identified patent and that said Letters Patent are hereby corrected as shown below:

Column 1, lines 61-62, "tolerances" should be --tolerance--.

In Table I, column 2, line 15, a closing parenthesis should be inserted after "50%".

Column 5, line 28, the first number in the equation which is "0.66" should be --0.61--.

Column 8, line 15, "or" should be --of--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*